US005485745A

United States Patent [19]

Rademaker et al.

[11] Patent Number: 5,485,745

[45] Date of Patent: Jan. 23, 1996

[54] MODULAR DOWNHOLE INSPECTION SYSTEM FOR COILED TUBING

[75] Inventors: Robert A. Rademaker, The Colony; John J. Goiffon, Dallas; Michael L. Connell, Houston; Walter K. Olszewski, Garland, all of Tex.

[73] Assignee: Halliburton Company, Dallas, Tex.

[21] Appl. No.: 938,622

[22] Filed: Sep. 1, 1992

Related U.S. Application Data

[63] Continuation-in-part of Ser. No. 703,287, May 20, 1991, abandoned.

[51] Int. Cl.[6] ..... E21B 47/00

[52] U.S. Cl. ..... 73/151; 385/90; 385/94; 340/854.7; 340/854.9; 340/855.1

[58] Field of Search ..... 73/151, 152; 385/90, 385/92, 94, 101, 107, 108; 340/854.7, 854.9, 855.1; 358/99, 100

[56] References Cited

U.S. PATENT DOCUMENTS

| | | | |
|---|---|---|---|
| 3,066,969 | 12/1962 | Camac | 358/100 |
| 4,744,626 | 5/1988 | Mery | 385/90 |
| 4,938,060 | 7/1990 | Sizer et al. | 73/151 |
| 4,941,349 | 7/1990 | Walkow et al. | 73/151 |
| 5,140,319 | 8/1992 | Riordan | 358/100 |

*Primary Examiner*—Hezron E. Williams
*Assistant Examiner*—Michael J. Brook
*Attorney, Agent, or Firm*—Jenkens & Gilchrist

[57] ABSTRACT

A downhole inspection tool is attached to the lower end of a length of coiled tubing having an electrical/fiberoptic cable threaded through the center. The coiled tubing carries a flow of optically clear and/or acoustically homogeneous fluid from a supply of such fluid at the surface. The tool itself includes a cable head subassembly module attached to the lower end of the coiled tubing and terminates the electrical and optical conductors within the cable. An inspection module for producing an electrical signal indicative of downhole conditions is detachably connected to the lower end of the cable head assembly module. An outer flow tube is mechanically connected to the inspection module and surrounds both of the modules to define an annular space therebetween. The flow tube has its upper end fluid coupled to the coiled tubing for conducting the flow of the optically clear and/or acoustically homogeneous fluid down along the annular space and out the lower end of the tool to create a region conducive to inspection by the tool.

27 Claims, 6 Drawing Sheets

MODULAR DOWNHOLE INSPECTION SYSTEM FOR COILED TUBING

CROSS-REFERENCE TO RELATED APPLICATION

This application is a continuation-in-part of U.S. patent application Ser. No. 07/703,287 filed May 20, 1991, now abandoned entitled "Reeled Tubing Support For Downhole Equipment Module" and assigned to the assignee of the present invention.

BACKGROUND OF THE INVENTION

1. Field of the Invention

The invention relates to coiled tubing mounted inspection tool systems, and more particularly, to a modular downhole inspection tool for selective attachment to the end of a length of coiled tubing. The invention may be practiced in connection with the maintenance and servicing of oil, gas, geothermal and injection wells.

2. History of the Prior Art

In the drilling and production of oil and gas wells, it is often necessary to obtain at the surface information concerning conditions within the borehole. For example, tools and other objects may become lodged in the borehole during the drilling of a well. Such objects must be retrieved before drilling can continue. When the removal of foreign objects from a borehole is undertaken, known as "fishing", it is highly desirable to know the size, position and shape of the obstructing object in order to select the proper fishing tool to grasp the object and remove it from the borehole. In addition, it is often desirable to confirm the operational condition of a piece of downhole production equipment, for example, whether or not the ports of a sliding sleeve valve are open or closed, in order to rely upon that condition in an operational procedure. Such information is very difficult to obtain because of the hostile downhole environment within a borehole filled with opaque drilling fluids.

In the operation and/or periodic maintenance of producing injection wells, it is also frequently necessary to obtain information about the construction and/or operating condition of production equipment located downhole. For example, detection of the onset of corrosion damage to well tubing or casing within the borehole enables the application of anti-corrosive treatments to the well. Early treatment of corrosive well conditions prevents the highly expensive and dangerous replacement of corrosion damaged well production components. Other maintenance operations in a production well environment, such as replacement of various flow control valves or the inspection of the location and condition of casing perforations, make it highly desirable for an operator located at the surface to obtain accurate, real-time information about downhole conditions. The presence of production fluids in the well renders accurate inspection very difficult.

Wireline tools, such as that shown in U.S. Pat. No. 3,401,749, have long been used in downhole environments including those which are mounted to a length of coiled tubing, as in U.S. Pat. No. 4,877,089, and to such tubing through a coaxial coiled tubing cable head, as in U.S. Pat. No. 4,941,349. Moreover, the use of coiled tubing to position a downhole tool and enable the accurate orientation of such a tool is shown in U.S. Pat. No. 4,685,516. Various related techniques have been proposed for obtaining at the surface information about the conditions within a borehole.

One approach has been to lower an inspection device, such as an optical or acoustical sensor positioned on the end of a section of coiled tubing, into the borehole and produce a slug or "bubble" of optically transparent and/or acoustically homogenous fluid within the borehole to enable the accurate inspection by the inspection sensor attached to the lower end of the tubing. Such a system is shown in U.S. Pat. No. 4,938,060 to Sizer et al. and assigned to the assignee of the present invention.

In addition, in the case of optical inspection sensors of the type shown in the Sizer et al. patent, it is also desirable to provide a means for simultaneously cooling the downhole sensor equipment as well as injecting the optically transparent and/or acoustically homogenous fluid within the borehole which enhances the observation and inspection functions performed by the equipment. Such a system is shown in parent U.S. patent application Ser. No. 07/703,287, filed May 20, 1991 and assigned to the assignee of the present invention.

In systems such as that shown in the parent application hereto, a television camera is mounted to the lower end of a length of coiled tubing and connected to monitoring and recording equipment at the surface by a transmission line such as a fiberoptic or coaxial cable. Coiled tubing units represent a very large capital investment and the operator of such a unit may desire to use the unit for other applications, such as the injection of nitrogen or other fluids into a wellbore or the attachment of standard electric logging tools, as well as a downhole inspection system. In such cases, providing the downhole inspection equipment as a modular unit which may be selectively connected and disconnected from the coiled tubing would be highly desirable. Further, providing modular downhole inspection equipment which is fluid and pressure sealed from the interior of the length of coiled tubing would provide advantages in the event the inspection module was stuck or lodged downhole and it became necessary to separate the coiled tubing from it in order to first remove the coiled tubing and then recover the lodged equipment with a fishing tool. In addition, for a separable inspection module in which a data transmission means incorporating a coaxial fiberoptic cable is employed to couple the signal from the inspection tool to the surface, sealing of the lower end of the optical fibers of the cable from pressurized liquids within the borehole when the tool is separated is essential in order to prevent a substantial loss of expensive cable due to intrusions of fluid into the cable fibers due to capillary action.

It would be an improvement in coiled tubing mounted downhole inspection systems if a fluid pressure sealed and transmission line equipped coiled tubing module unit could be plug connectable to the inspection imaging and electronics modules to allow multiple uses of the coiled tubing module as well as to minimize damage to the equipment in the event the tool becomes lodged downhole and necessitates separation of the tubing module from the other downhole equipment. In addition, it would be desirable to provide such a modular inspection system which allows threading of a sealed coiled tubing cable head module through a coiled tubing injector prior to plug connection of the electronics and imaging modules of the inspection tool.

SUMMARY OF THE INVENTION

The present invention is directed to an improved method and apparatus for sensing conditions within a borehole.

In one aspect, the present invention includes a downhole inspection tool for attachment to the lower end of a length of coiled tubing having an electrical/fiberoptic cable threaded therethrough. The coiled tubing carries a flow of optically clear and/or acoustically homogenous fluid from a supply of such fluid at the surface. The tool includes a cable head subassembly module attached to the lower end of the coiled tubing and incorporates means for terminating the electrical and optical conductors within the cable. An inspection module is included for producing an electrical signal indicative of downhole conditions. The inspection module is detachedly connected to the lower end of the cable head assembly module and an outer flow tube is mechanically connected to the inspection module and surrounds both of the modules to define an annular space therebetween. The outer flow tube has its upper end fluid coupled to the coiled tubing for conducting the flow of the optically clear and/or acoustically homogeneous fluid down along the annular space and out the lower end of the tool to create a region conducive to inspection by the tool.

In a further aspect, electrical/fiberoptic cable of the downhole inspection tool includes an inner core of optical fibers within a metal tube surrounded by an insulative jacket over which is formed a braided conductive layer also surrounded by an insulative layer over which two layers of a stranded conductor are wound in a reverse lay for strength. In the cable head subassembly of the tool the outside surface of the cable is sealed against the fluid flowing down the coiled tubing. The stranded outer conductor of the electrical/fiberoptic cable is mechanically clamped to secure the cable within the cable head subassembly. An upward force applied to the coiled tubing serves to disconnect the subassembly from the inspection module and remove it from within the borehole in the event the outer flow tube becomes lodged downhole. The stranded conductor is cut away below the mechanical clamp means to expose the insulative layer. An enclosed chamber is provided for containing the electrical and optical terminations of the remaining conductors within the cable and the insulative layer of the cable is fluid and pressure sealed against fluid intrusion into the enclosed chamber.

In still another aspect, the invention includes a system for using a downhole inspection tool to inspect the interior of a borehole. A cable head subassembly module is attached to the lower end of a length of coiled tubing having an electrical/fiberoptic cable threaded therethrough. The module includes means for terminating the electrical and optical conductors within the cable and for mechanical and electrical connection to an inspection module capable of producing an electrical signal indicative of downhole conditions. An injector feed through boot protector is connected to the mechanical terminating means of the cable head subassembly module with the protector receiving the electrical terminating means of the subassembly module. The boot protector, cable head subassembly module and coiled tubing attached thereto are inserted through a coiled tubing injector and the boot protector removed from the cable head subassembly module to allow a downhole inspection tool to be attached to it and the tool is run downhole to inspect downhole conditions.

In yet another aspect, the invention includes a downhole logging tool for use in gathering data within a borehole and sending those data to monitoring equipment at the surface by means of a fiberoptic cable. A system for coupling a data signal into the optical fibers of the cable includes a light emitting diode for receiving an electrical signal indicative of the downhole data and converting the electrical signal into an optical signal. The butt end of the optical fibers of said cable is terminated and the light emitting diode is mounted for selective longitudinal positioning along an line substantially coaxial with the optical fibers of the cable to position the terminated end of the optical fibers in an abutting relationship with the light emitting diode and couple the optical signals produced by the diode into the optical fibers of the cable for transmission to the surface without requiring any bends in the cable and regardless of the length to which the butt ends of said fibers have been trimmed in order to terminate them.

BRIEF DESCRIPTION OF THE DRAWINGS

For more detailed understanding of the present invention for further objects and advantages thereof, reference can now be had to the following description taken in conjunction with accompanying drawings, in which.

DETAILED DESCRIPTION

Figure 1:
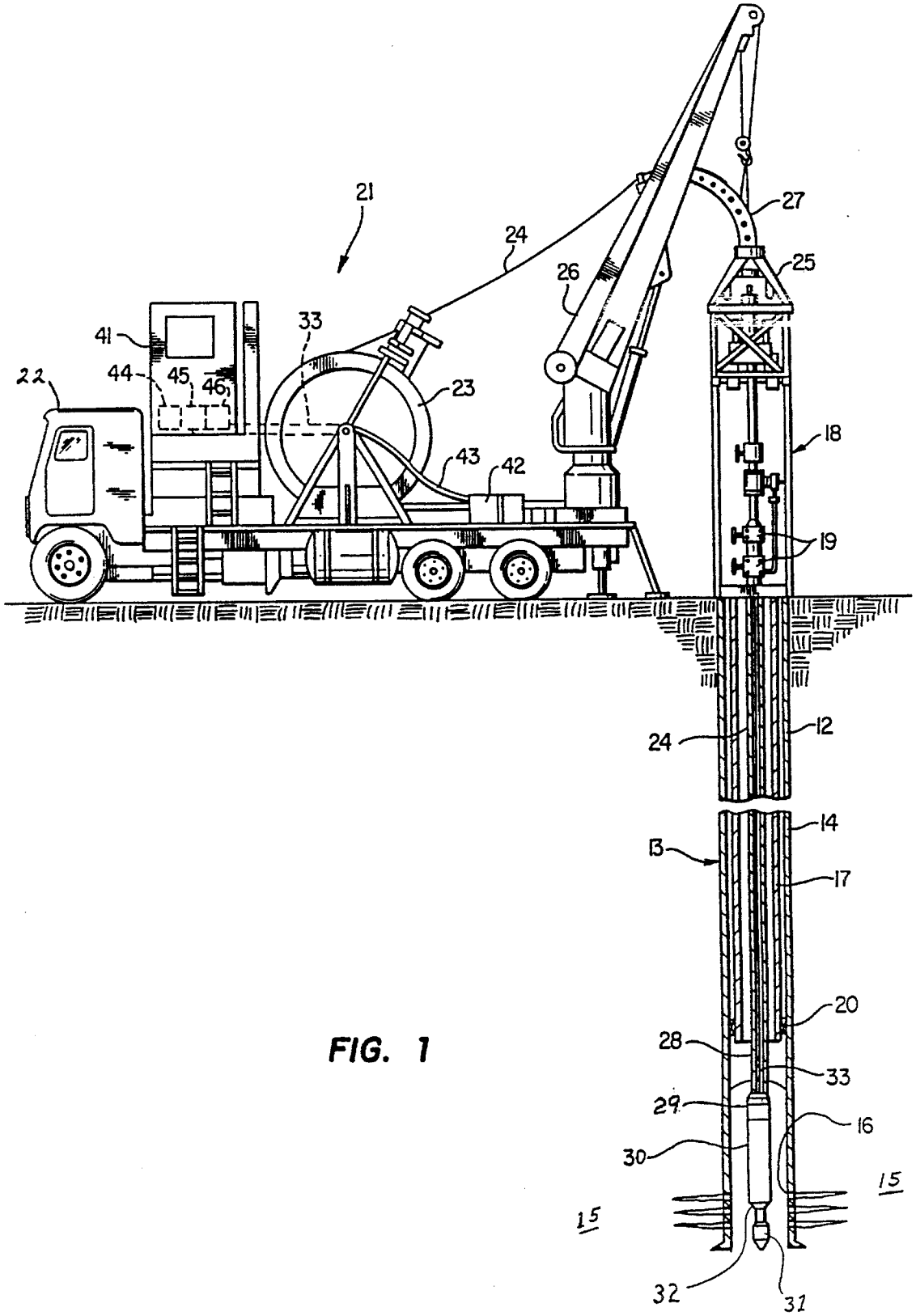
FIG. 1 is an illustrative schematic drawing, partially in elevation and partially in cross-section showing a borehole inspection system of the type employed in the present invention.

Referring to FIG. 1, there is shown a borehole 12 forming part of a completed production well 13 which includes a casing 14 extending from the surface to the production zone 15 of the well The casing includes a plurality of perforations 16 formed in the wall thereof to allow the influx of production fluids from the producing formation into the borehole for removal at the wellhead. A production packer 20 is positioned between the tubing 17 and the casing 14 above the production zone 15.

A string of production tubing 17 extends from the wellhead production completion equipment 18, known as a "christmas tree", to allow the fluids flowing into the casing 14 from the formation to be received at the surface for collection of production fluids from the well. The various valves 19 at the wellhead 18 control the flow of production fluids brought to the surface through the tubing.

Also as shown in FIG. 1 is an item of production well maintenance equipment 21 known as a coiled tubing unit. This system comprises a truck 22 onto a bed of which is mounted a large mechanically operated coil 23 upon which is wound a continuous length of metal tubing 24 capable of withstanding relative high pressures. The tubing 24 is slightly flexible so as to be able to allow coiling of the tubing onto the reel 23. A coiled tubing injector unit 25 is suspended over the wellhead 18 by a hydraulic crane 26 and is directly attached to the wellhead. The injector 25 includes a curved guideway 27 and a hydraulic means for injecting the coiled tubing 24 down into the well tubing 17 while the well remains under production pressure. A sufficient length of tubing 24 is inserted into the well such that the lower end of the coiled tubing 28 extends out the lower end of production tubing 17 into the region of the borehole inside the casing 14. The production zone 15 is deemed, for purposes of illustration, to be the borehole inspection zone of interest.

Attached to the lower end of the coiled tubing 24 is an inspection tool 28 comprising a coiled tubing cable head subassembly module 29 which is received into a fluid flow tube 30 which is in fluid communication with the inside of the coiled tubing 24. A fiberoptic and electrical cable 33 is connected to the coiled tubing cable head 29 and extends longitudinally up the interior of the coiled tubing 24 to the receiving and control equipment located at the surface adjacent to the wellbore. Tubing 24 conducts injection fluids to a precise location within the borehole selected by the positioning of injection nozzle 32 as well as protects the length of the fiberoptic communications cable 33 extending between the inspection sensor sub 31 and the surface. The flow tube also enshrouds an inspection module comprising an electronics module as well as an inspection sensor imaging module such as a video camera assembly located near the lower end thereof to produce video images of subject matter within the casing 14 illuminated by a light head 31. Clear fluid flowing down the coiled tubing 24 exits from a fluid injection nozzle region 32 located at the lower end of the flow tube 30.

Communications and power cable 33 may for certain applications comprise a coaxial cable for high frequency data communications, however, the preferred embodiment employs optical fibers which both greatly improves the quality of video transmission but also reduces the diameter and weight of the cable. The coiled tubing cable head subassembly module 29 is fitted with equipment, as will be further shown below in connection with FIGS. 3A–3E, to seal off the fluid in the tubing from both the electrical and optical cable connections, convert the electrical signal to/from the camera electronics to/from an optical signal, and enable the sealed coiled tubing subassembly module to be removed from the borehole without the camera and electronics modules in the event they become stuck downhole.

The coiled tubing unit 21 carries an operator control housing 4] and a pair of pumps 42 connected to the upper end 43 of the coiled tubing 24 to supply pressurized fluids into the tubing from the surface. Pumps 42 are connected to a-supply fluid (not shown). A pump control console 44 is located within the operator housing 41 and adapted to control the operation of the pumps 42. The upper end of the fiberoptic/electrical cable 33 extending longitudinally along the interior of the coiled tubing 24 is connected to a sensor control unit 45 and a sensor monitor 46 both of which are located within the operator housing 41. When the inspection sensor is a television camera, as in the preferred embodiment, the sensor monitor and control units 45 and 46 may include a video logging unit comprising a fiberoptic video receiver, electrical slip rings, a depth encoder, system power supplies, a communications processor, a character generator, a video typewriter, video monitors and video recorders. The coiled tubing unit 21 is fitted with the equipment required to seal off the fluid in the tubing from the cable connections, convert the optical signal to an electrical signal, and carry that signal into a cable to the video logging unit. The fiberoptic/electrical cable 33 is used to carry both electrical power and control signals downhole to power the lights and camera and control the camera as well as video signals back uphole from the camera to the sensor control unit 45 and television monitor 46.

Figure 2:
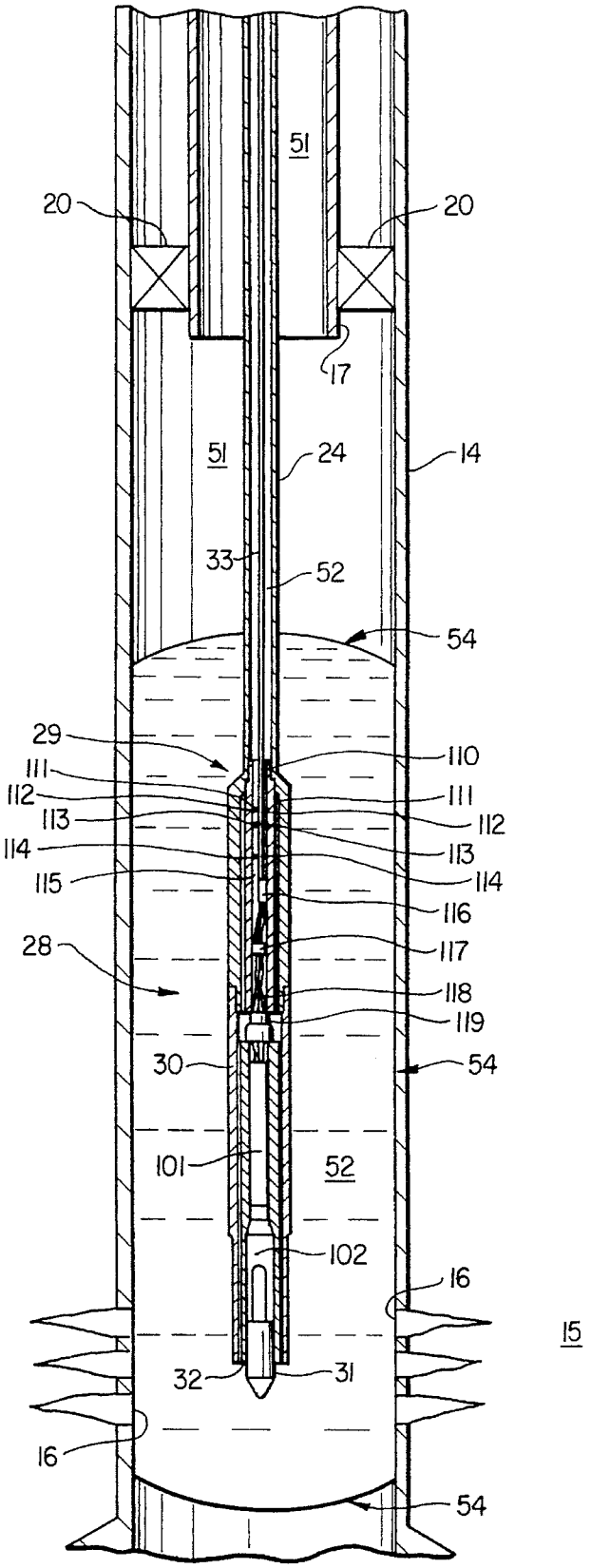
FIG. 2 is a longitudinal cross-section view of the lower end of a coiled tubing support for a downhole inspection equipment module constructed in accordance with one aspect of the teachings of the present invention.

Referring now to FIG. 2, there is shown an illustratively enlarged cross-section view of the lower end of the coiled tubing 24 and the borehole inspection zone 15. The lower end of the production tubing 17 is sealed on the outside against the inner wall of the casing 14 by means of a production packer 20. Production fluids 51 which flow into the casing 14 through the perforation 16, travel up to tubing 17 toward the wellhead. The production fluids 51 generally comprise oil, salt water and other opaque and frequently non-homogenous fluids.

As discussed above in connection with FIG. 1, the pumps 42 are connected to the upper end 43 of the coiled tubing 24 and to one or more supplies of fluid. From the surface, an optically clear and/or acoustically homogenous fluid 52, from one of the sources connected to one of the pumps 42, is pumped down the coiled tubing 24 in the direction downhole and toward the nozzle 32 in the lower end 28 of the coiled tubing. This fluid forms an isolated zone or "pill" 54 of optically transparent and/or acoustically homogenous fluid 52 in the region of the inspection tool 28. This enables the television camera of the inspection tool 28 to accurately inspect the interior conditions within the borehole. For example, with the injection of pill 54 of clear fluid the condition of the inner sidewalls of the casing 14 can be optically and/or acoustically inspected without any obstruction from the opaque, non-homogenous borehole fluids 51 normally present within the borehole. Signals produced by the inspection tool 28 are relayed up the fiberoptic cable 33 to the sensor monitoring and control units 45 and 46 within the operator housing 41 located at the surface.

Fluid 52 which is pumped down the coiled tubing 24 under pressure by means of pumps 42 located at the surface, may comprise a number of different fluids depending upon the inspection sensor selected for the particular application and operating conditions. For example, clear fluid media such as water, nitrogen, light hydro-carbons, natural gas, CO2, and many others may be acoustically homogenous and optically clear and thus provide a suitable medium for careful and accurate inspection of the downhole conditions by the sensor.

Referring in more detail to FIG. 2, there is shown an enlarged cross-section view of coiled tubing supported downhole inspection equipment modules constructed in accordance with the teachings of the present invention in which various dimensions have been changed for purposes of illustration. In FIG. 2, the lower end of the coiled tubing 24 is positioned in a borehole inspection zone 15. The lower end of the production tubing 17 is sealed on the outside against the inner wall of the casing 14 by means of the production packer 20. Production fluids 51 which flow into the casing 14 through the perforation 16 travel up the tubing 17 toward the wellhead.

As discussed above, one of the pumps 42 are connected to the upper end of the coiled tubing 24 and a supply of fluid. From the surface, optically clear and/or acoustically homogenous fluid 52 from the fluid supply connected to one of the pumps 42, is pumped down the coiled tubing 24 in the direction of arrows 53 towards the lower end of the tubing.

Connected to the lower end of the tubing 24 is the modular inspection tool 28 which includes the coiled tubing cable head subassembly module 29, and an inspection module comprising the electronics module 101 and the television camera and light sensor module 102 all of which are enclosed within the outer flow tube 30. A general overview of the principle components of the modular inspection tool 28 will be given here in connection with FIG. 2, however, the details of the construction and operation of the various elements thereof will be specified below in connection with FIGS. 3A–3E. The cable head subassembly module 29 includes a cable head that is attached to the lower end of the coiled tubing 24. The cable head comprises a crossover adapter 110 which is crimped onto the end of the coiled tubing and has a plurality of ports 111 drilled through it to allow the optically clear fluid to exit from it into the outer flow tube 30. A rubber pack-off 112 is located in the downhole end of the crossover adapter 110 and directs the fluid flow into the ports 111. A cable clamp sub 113 is attached to the downhole end of the crossover adapter 110 to secure the cable 33 mechanically to the cable head.

A cable seal sub 114 is attached to the lower end of the cable clamp sub 113 to prevent pressure and fluid incursion into a diode chassis chamber 115. A fiber optic connector 116 is attached to the lower end of the cable 33 and enclosed within the diode chassis 115 which is attached to the cable seal sub 114. The sealed diode chassis 115 protects the fiber connection, the electrical power connection and the light emitting diode (LED) and its housing (not shown) which converts the video data from the electronics module 101 into a modulated light signal for transmission up the cable 33 to a receiver at the surface. An electrical bulkhead connector assembly 117 is located at the downhole end of the diode chamber 115 and serves as a pressure seal for the diode chamber. The lower end of the housing of the diode chamber 115 is attached to a bulkhead which has a fishing neck 118 attached to it. The fishing neck 118 is attached to a fishing neck housing with shear wires so that it will be exposed in the event of an emergency separation of the upper coiled tubing cable head subassembly module 29 from the inspection module comprising the lower electronics and camera and light modules 101 and 102. The fishing neck 118 is attached to a quick disconnect connector assembly 119 that allows the electronics and camera modules 101 and 102 to be easily attached and removed from the cable head subassembly module 29. This quick disconnect connector assembly 119 also allows the electronics and camera modules to be removed and replaced with a temporary boot protector cover that permits the approximately 1¼ inch diameter cable head subassembly module 29 to be inserted through the grippers of a coiled tubing injector at the well head. After passing through the injector, the quick disconnect connector 119 is reinstalled so that the somewhat larger diameter, e.g. approximately 1 11/16 inch, electronics and camera modules 101 and 102 can be reattached to the cable head subassembly module.

The camera lens is located near the light head 31 at the lower end of the camera module 102. The light head 31 may take the external form shown in FIG. 2 or the form of an internal ring as illustrated in FIG. 3E. The outer flow tube 30 surrounds the entire cable head subassembly module 29 as well as the inspection module, comprising the electronics module 101 and the camera module 102, down to exit ports 32 at the lower end of the tool 28. This allows the flow of fluid out of the lower end of the tool housing 28 in the downward direction in front of the camera lens. The fluid then flows back upwardly in the borehole and ensures that there is a region of clear fluid directly in the optical inspection path of the television camera.

Electrical conductors within the cable 33 runs coaxially to the optical fibers thereof and supplies the power to run the downhole electronic module 101, camera module 102 and light 31. A circuit oversees the amount of power required by the television camera and its support electronics 101 and determines the amount of energy to be directed to the light source 31. Electrical power is supplied to the upper end of the cable 33 by the system power supply located in the video logging unit at the surface and may be adjusted by the operator to fine tune the video images being viewed and recorded.

Referring next to FIGS. 3A–3E, there is shown a detailed longitudinal cross-section view of a downhole inspection tool 28, and especially the coiled tubing cable head subassembly module 29 thereof, constructed in accordance with the teachings of the present invention. The lower end of the coiled tubing 24 is received onto the upper end of the cable head cross-over adapter 110 comprising a reduced cylindrical neck section 202 having a plurality of circumferential recesses **203*a*–203*d* longitudinally spaced from one another. The circumferential recesses 203*a* and 203*c* are filled with epoxy and the cylindrical wall of the coiled tubing is crimped down into the recesses 203*b* and 203*d* to form a firm sealed connection therebetween. An o-ring 204 assists in sealing the lower end of the coiled tubing 24 onto the neck of the cross-over adapter 110. An internal fishing neck 205 includes a circumferentially extending interior recess 201 for engagement by a fishing tool lowered from the wellhead to grip the fishing neck 205 and withdraw it from the borehole in certain situations. The cross-over adapter 110 extends down through the upper end of a seal sub 208 and is fluid sealed thereagainst by an o-ring 209. The lower edge of the seal sub 208 connects to the upper end of the outer flow tube 30 and terminates just above a plurality of orthogonally spaced flow ports 111 formed in the cross-over adapter 110. The ports 111 allow clear fluid flowing from the coiled tubing 24 down through the interior of the cross-over adapter 110 to exit and continue on down along the annular region just inside the walls of the flow tube 30**.

The construction of the fiberoptic/electrical cable 33 extending down the interior of the coiled tubing 24 preferably comprises a centrally located core of optical fibers surrounded by a stainless steel tube which is then covered with a first layer of polypropylene insulation. A small amount of silicone grease may optionally be included as a lubricant and support agent for the fibers within the tube. Next, a layer of braided copper conductive strands surrounds the inner polypropylene insulation which is in turn covered by an additional layer of polypropylene material to protect and insulate the copper braid. Finally, two layers of high tensile strength steel strands are wound in a reverse lay to form an outer protective layer around the polyethylene insulative layer which provides both longitudinal strength to the cable 33 as well as an additional conductive path. While the above construction of the cable 33 is preferred, other configurations could be employed. For example, only one optical fiber could be included in the core of the cable if that is sufficient to carry the data required for the particular application and, thus, the term optical "fibers" as used in the specification and claims of this application should be construed as including a single optical "fiber". Other embodiments of suitable cables could be adapted for use in the present invention, such as the cable shown in U.S. patent application Ser. No. 07/702,827, filed May 20, 1991, now U.S. Pat. No. 5,275,038, and entitled "Downhole Reeled Tubing Inspection System With Fiberoptic Cable", which is assigned to the assignee of the present invention and hereby incorporated by reference.

One of the functions of the cable head subassembly module 29 of the present invention is to provide means for terminating various layers of the cable 33 and adequately sealing various parts of it from intrusion by borehole fluids while at the same time avoiding bends in the optical fibers of the cable and thereby preventing the introduction of optical attenuation. The outermost layer of steel strands surrounding the cable 33 extend through an axial opening within a cable pack-off 112 formed of resilient material and positioned within the interior of the crossover adapter 110. The upper end of the pack-off 112 closes the lower end of the central aperture of the crossover adapter 110 and forces fluid to exist through the ports 111. A pack-off compression nut 210 is threadedly received within the interior of the crossover adapter 110 and, in response to rotation, the nut 210 applies axial pressure to the cable pack-off 112. The pack-off 112 tightly squeezes the exterior surface of the steel stand portion 33*a* of the cable 33 to seal it against the flow of water and debris and divert the flow of the optically clear fluid flowing into the crossover adapter 110 out through the ports 111. A lock spring 211 serves to rigidly engage the lower end of the crossover adapter 110 with the upper threaded end of a cable clamp sub 113 within which is received an end cone 213. An upper end cone 213*a* is longitudinally fixed within a cavity formed by recessed shoulders within the cable clamp sub 113 and includes a circular opening in the upper end thereof to allow passage of the steel stranded exterior surface 33*a* of the cable 33. A double cone 214 is formed of electrically conductive gripping material such as stainless steel and has opposed tapered ends received into the tapered cone shaped interior walls of the upper end cone 213*a* and a lower end cone 213*b*. A cable clamp nut 215 is threadedly received into the interior of the cable clamp sub 113 and rotation of the nut 215 decreases the spacing between the upper end cone 213*a* and the lower end cone 213*b* causing the double cone 214 to compress its inner walls against the stranded outer steel wires 33*a* of the cable to grip and mechanically hold the cable in place and keep it from slipping longitudinally within the cable clamp sub 113. Just below the lower edges of the double cone 214, the stranded armor wires 33*a* of the cable 33 are stripped back and cut away at 33*b* to leave a polyethylene covered insulated layer 33*c* extending on down the sub.

A lock spring 212 locks the threaded lower end of the cable clamp sub 113 to the upper threaded end of a cable seal sub 114. An elongate stainless steel cable seal insert 218 serves as a spacer and retains the sealing components 262, 285, and 216. Below the cable seal insert 218 is located a cavity within which is positioned a stack of fluid and pressure sealing members comprising a stacked array of small diameter o-rings 262, somewhat larger diameter o-rings 285 and cable seal holders 216. Abutting the lower edge of the stack of sealing members within the cable seal sub 114 is a compression nut 223 which is threadedly received and tightened into the threaded lower end of the cable seal sub 114. The nut 223 retains the stack of sealing members 262, 285, and 216 which seals against the outside polypropylene surface 33*c* of the cable 33 and seal borehole pressure and fluid from passage into the interior of a diode chassis housing 226 fixed to the lower end of the cable seal sub 114 by socket head screws 219. The lower outside edges of the cable seal sub 114 are sealed against the upper inner edges of the diode chassis housing 226 by an o-ring 220 and a backup ring 221. When the compression nut 223 of the cable seal sub 114 is threaded into position, the diode chassis 115 is affixed to the compression nut 223 by means of flathead screws 222. A socket head screw 224 is used to connect a ground wire 230 to the compression nut 223. The diode chassis 115 is integrally connected to the metal body components of the cable head subassembly 29 which is electrically connected to the stranded steel conductors 33*a* of the cable 33. The diode chassis 115 is a sealed chamber formed by the two split-halves of a cylindrical tube which allows it to be separated into two halves along a longitudinal axis for ready access to the various cable and diode connections contained within the protected interior thereof. In addition, since electrical power is carried in the cable 33 with one conductive member being formed by the steel strands 33*a* and the other being formed by the copper braiding 33*e* within the polyethylene layer 33*c*, the wire 230 forms a solid electrical ground connection.

Figure 3A:
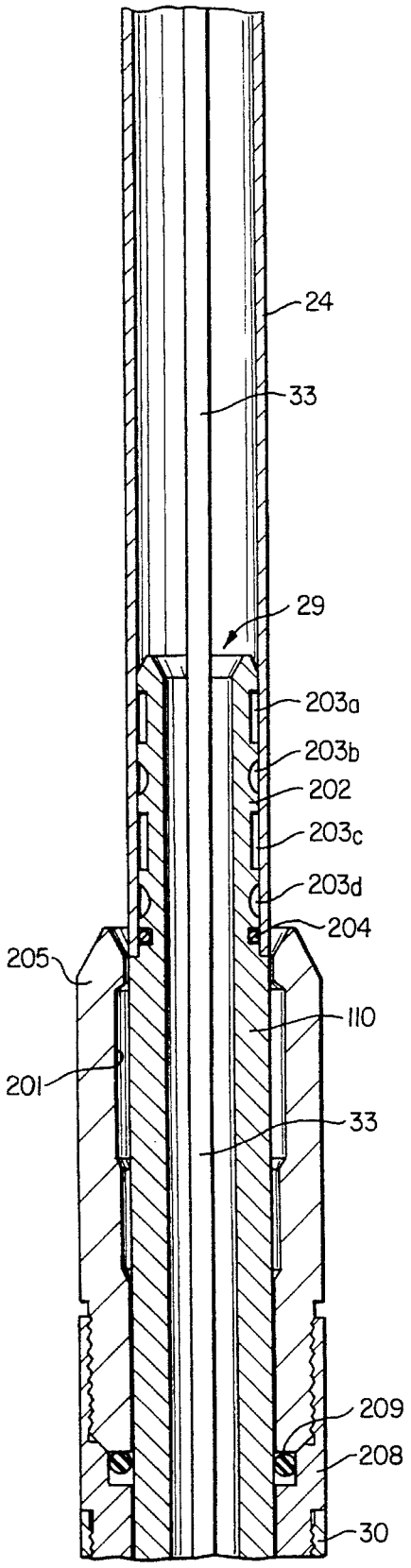
FIGS. 3A–3E show a longitudinal cross-section view of a modular downhole inspection tool constructed in accordance with the teachings of the present invention.
Figure 3B:
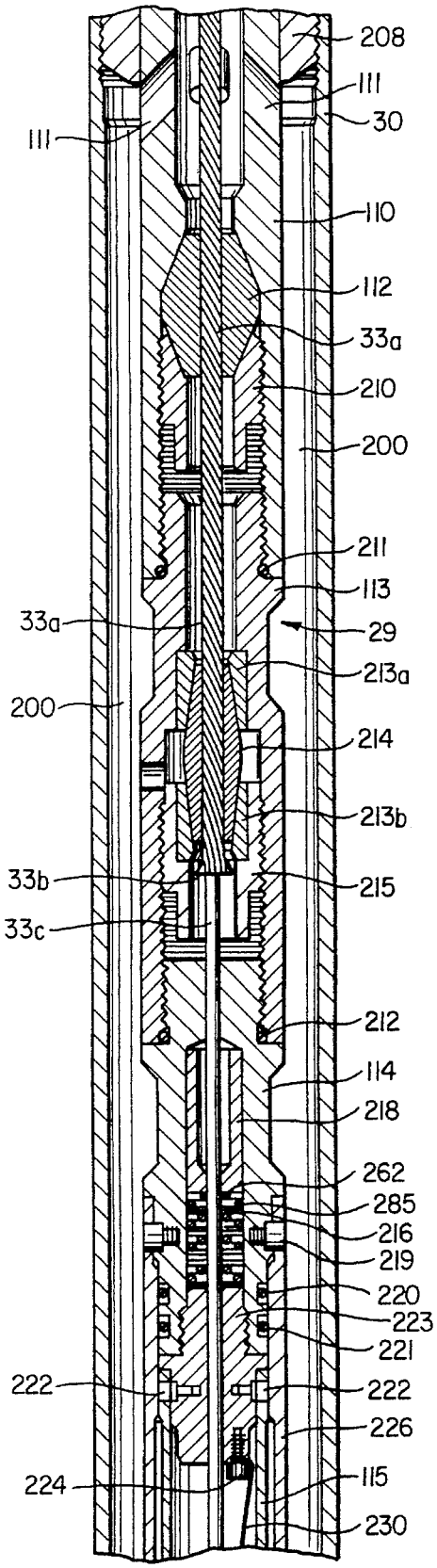
Figure 3C:
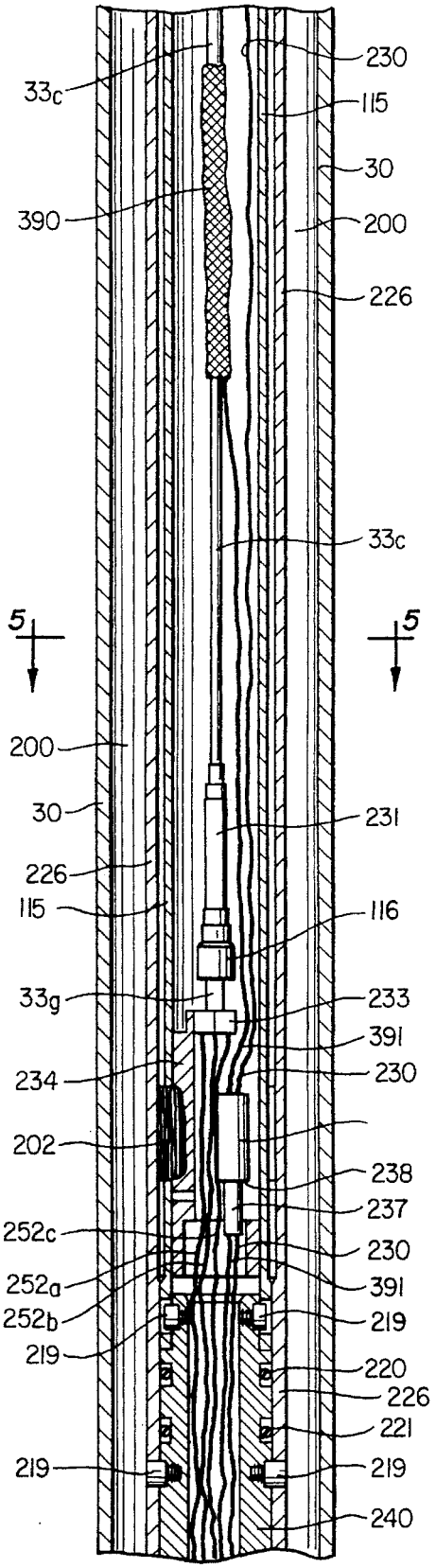
Figure 4A:
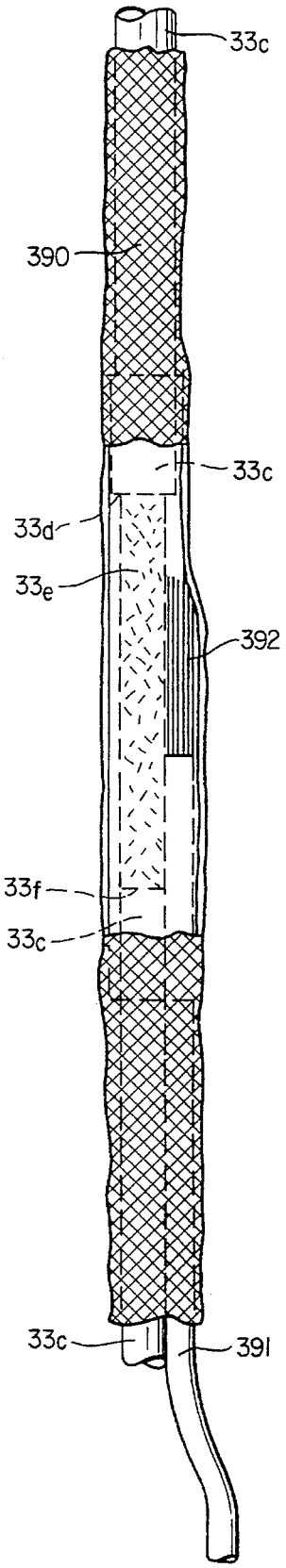
FIG. 4A shows a partially cross-section detailed view of certain wire connections shown in FIG. 3C.

Referring next to FIG. 3C, the hatched region 390 represents a heat shrinkable outer insulative covering overlying a soldered electrical connection. Referring briefly to FIG. 4A, the region underlying heat shrink 390 is shown in greater detail. There it can be seen that the polypropylene insulative layer 33*c* of the cable 33 is terminated at point 33*d* leaving exposed a length of the braided copper shielding 33*e* forming the power conductor within the cable 33. The braided copper conductor 33*e* is only exposed over a short distance and the polypropylene insulative layer 33*c* begins again at 33*f*. A power wire 391 has its end 392 stripped bare, fluxed and soldered to the stranded copper braiding 33*e* to provide a secure mechanical and electrical connection therebetween. Thereafter, the heat shrink tube 390 placed over the entire connection, is heated and shrunk tightly down onto the solder connection to insulate and protect it from moisture which may inadvertently enter the system.

Referring back to FIG. 3C, the polypropylene outer coating 33*c* of the fiberoptic cable extends longitudinally within the split halves of the diode chassis 227 alongside the power conductor 391 and the ground conductor 230. The fiberoptic portion of the cable 33 is terminated by means of an ST multimode fiberoptic connector 116 which may, for example, be Model No. 501380-1 ST connector, manufactured by AMP, INC. of Harrisburg, Pa. Within the fiberoptic connector 116 the polypropylene insulation layers, copper braid, and steel tube protecting the optical fibers is stripped away to expose the fibers 33*g* the butt end of which are mounted contiguous to a light emitting diode 233 mounted on a diode holder 234. Once the termination within the multimode connector 116 is complete, a heat shrink 231 is applied therearound and shrunk to protect the finished connection. Located near the diode holder 234 is an electrical connector assembly 235 which incorporates a female socket 238 into which a male terminal plug 237 is fitted for electrical connection of power and ground circuit wires 230 and 391. The receptacle and plug 238 and 237 allow ready connection of the power and ground leads in the event of trouble shooting and maintenance activities. The diode holder 234, along with the diode 233, are mounted for longitudinal movement and selective axial positioning within the diode chassis 115. This enables the fiberoptic cable 33, and particularly the portion of the cable 33*c* between the lower end of the cable seal sub 114 and the multimode connector 116 to be positioned within the diode chassis 115 along a straight, linear axis without any significant bends therein which might produce optical attenuation of the signal being conducted by the optical fibers. That is, the cable 33*c* can be arranged in a perfectly linear configuration and then the diode 233 moved into an abutting relationship against the butt end of the optical fibers in the region 33*g* by adjusting the axial position of the diode holder 234. This feature also facilitates maintenance of the fiberoptic cable 33 by enabling the butt end of the optical fibers at 33*g* to be periodically dressed whenever necessary by cutting off squarely the ends of those fibers to optimize the optical transmissivity thereof. The longitudinal position of the diode holder 234 is then adjusted so that the diode 233 is positioned squarely abutting the butt end of the somewhat shorter cable after trimming. Several wraps of glass tape 202 are placed in the region between the diode holder 234 and the inner side walls of the diode chassis 115 to provide frictional securement of the diode holder 234 at a chosen location. Thus, the longitudinal moveability of the diode holder 234 within the diode chassis 115 provides an essentially infinitely adjustable fiberoptic termination within the system.

Figure 5:
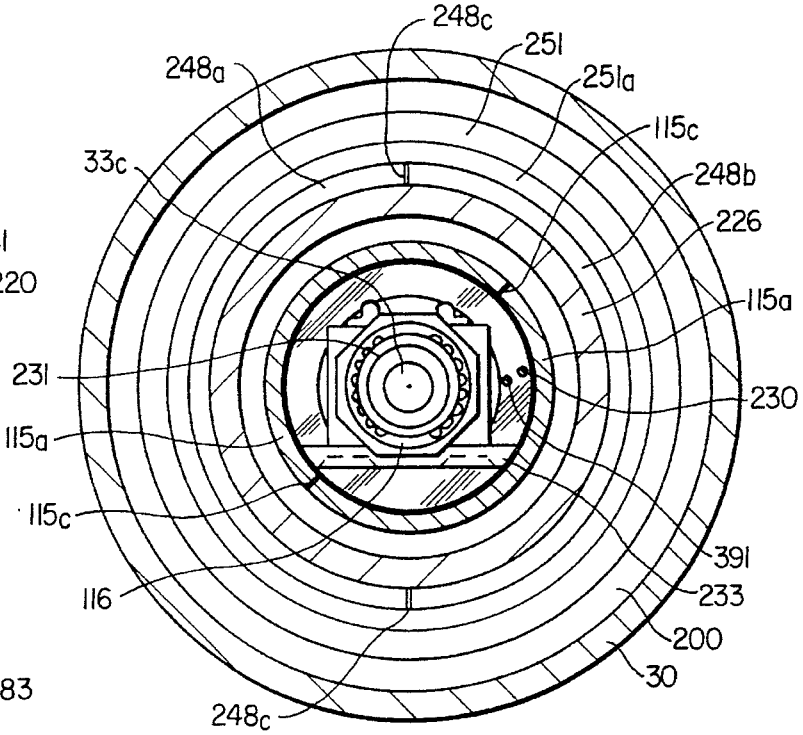
FIG. 5 is a cross-section view taken about the line 5—5 of FIG. 3C.

Referring briefly to the cross-section drawing of FIG. 5 taken about the lines 5—5 of FIG. 3C, there is shown the outer flow tube 30 within which is contained an annular fluid flow space 200 extending the length of the tool. The outwardly tapering upper edges of a collar 251 and the upper edge thereof 251*a* surround a pair of longitudinally split sleeves 248*a* and 248*b* which are divided into two semi-cylindrical halves fitted together at opposing joints 248*c* to form a cylindrical enclosure as will be further described below. The diode chassis housing 226 is spaced from and surrounds the diode chassis 115 which is split into two semi-cylindrical halves 115*a* and 115*b* and are fitted together at junctions 115*c* to form an enclosed sealed cylindrical housing for the diode. The two insulated electrical conductors comprising the power wire 230 and the ground wire 391, lie in the annular space between the diode chassis housing 226 and the diode chassis 115 comprising split halves 115*a* and 115*b*. Positioned within the diode chassis 115*a*–115*b* the diode holder 234 mounts a diode 233 into which is terminated the lower butt end of the fiberoptic cable 33*g*. The polypropylene layers, copper braid, and steel tube of the fiberoptic cable 33 is stripped away and terminated by means of the ST multimode connector 116 around which is positioned a heat shrink 231.

Returning to FIG. 3C, a pair of signal wires 252*a* and 252*b*, along with a chassis ground 252*c*, provide a driving signal to the diode 233 for converting video output signals from electrical to optical signals capable of being transmitted on the fiberoptic cable 33. A connector bulkhead 240 is received within the lower portion of the diode chassis housing 226 and is sealed against the inner walls thereof by a pair of o-rings 220 and backup rings 221. In addition, the diode chassis housing 226 is secured to the connector bulkhead 240 by means of socket head screws 219. The diode chassis housing 226 is the pressure and tension bearing member of the assembly and once the split halves of the diode chassis 115*a* and 115*b* are assembled the diode chassis housing 226 is slid into place thereover and placed onto the upper end of the connector bulkhead 240. The diode chassis housing 226 may be rotated with respect to the connector bulkhead 240 so that the screw holes are aligned and the socket head screws 219 are placed into position to fix the members with respect to one another.

Figure 3D:
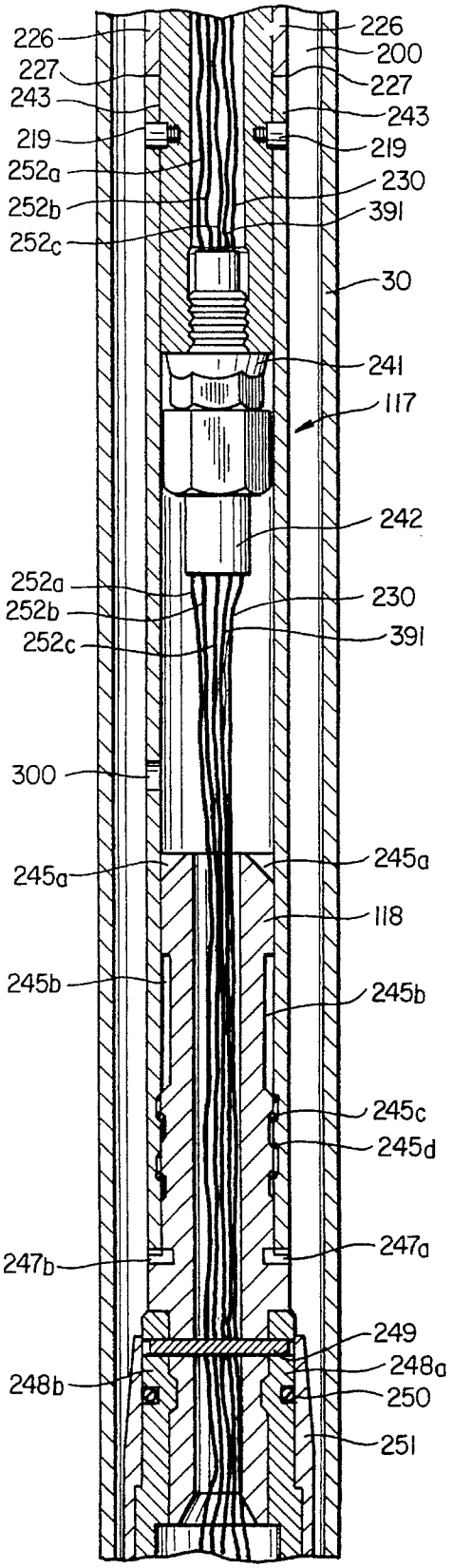
Figure 3E:
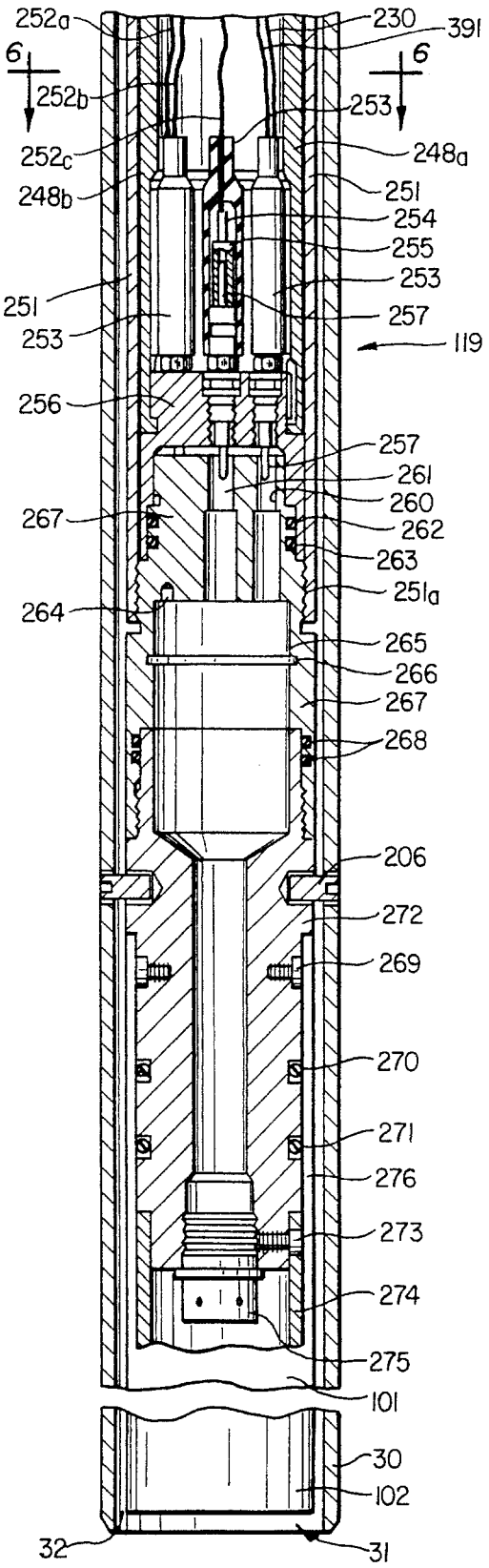

Referring next to FIG. 3D, an electrical connector bulkhead assembly 117 comprises a connector plug 241 which is a bulkhead type electrical connector that is pressure tight and allows passage of the electrical power conductors 230 and 391 as well as the LED signal conductors 252*a*, 252*b* and 252*c* while protecting the interior of the connector bulkhead 240 from outside fluids and pressures. A connector socket 242 is fitted into the connector plug 241 so that the electrical interconnection between conductors 230, 391, 252*a*–*c* is solidly made yet subject to disconnection upon longitudinal separation between the plug 241 and the socket 242.

The diode chassis housing 226 ends at 227 at which it abuttingly joins the upper edges of a fishing neck housing 243. A pressure equalization opening 300 is formed in the sidewall of the fishing neck housing 243, and the lower open end thereof receives a fishing neck 118. The upper end of the fishing neck 118 includes tapered upper edges 245*a* for aid in the assembly of the structure and attachment of a fishing tool, a central set of recesses 245*b* for engagement by a fishing tool, an upper shear wire 245*c* and a lower shear wire 245*d* for securing the fishing neck 245 on the lower end of the fishing neck housing 243. A pair of dowel pins 247*a* and 247*b* prevent rotation of the fishing neck 118 with respect to the fishing neck housing 243. The shear wires 245*c* and 245*d* serve as shear wires so that the tool separates at this point in the event of an emergency such as when the outer flow tube 30, and the components mechanically connected thereto, is stuck downhole. In such a case, a preselected upward force on the cable head subassembly 29, which includes the cross-over adapter 110, the cable clamp sub 113, cable seal sub 114, diode chassis housing 226 and fishing neck housing 243, will shear the wires 245*c* and 245*d* and allow that housing 243 to pulled upwardly separating it from the fishing neck 118 leaving the neck exposed. The entire cable head subassembly 29 can then be withdrawn from within the outer flow tube 30 and pulled to the surface of the borehole. The fishing neck 118 is attached to the upper end of a pair of split sleeves 248*a* and 248*b* which are enclosed within the collar 251. An o-ring 250 holds the split sleeves 248*a* and 248*b* together to facilitate assembly.

Referring next to FIGS. 3D and 3E, during assembly the split sleeve collar 251 is positioned upwardly from the split sleeves 248*a* and 248*b* and once the two halves of the sleeves are assembled, the collar 251 is pulled down over those split halves. Dowel pin 249 prevents the split sleeves 248*a* and 248*b* from rotating. The lower edge of the collar 251*a* receives a lower connector housing 267 which contains a plurality of contact assemblies 260 each of which contains a female contact pin 260 which fittingly receives a single pin of a feedthrough assembly 257 mounted within an upper housing 256. The power and signal connections 230, 391, 252*a*–*c* are each connected, respectively, to a contact socket assembly 255 enclosed within an insulative contact boot 253 which protects the assembly once the plug connection is made. A teflon insert 254 serves to insulate and support the contact boot 253 from collapsing. A plurality of feedthrough contact socket assemblies 255 are provided and enable each circuit which contains either a signal, power or a ground connection to be passed out from within the coiled tubing cable head subassembly 29 and adapted for a simple plug connection to the electronics and camera modules 101 and 102 by means of the quick disconnect connector assembly 119. Electrical connections within the assembly 119 are made to the electronic module 101 of the tool through the female contact pin assembly 260 contained within the lower connector housing 267 which is sealed to the upper housing 256 by o-rings 262 and 263. A roll pin 264 keeps the insulator block 265 from rotating within the housing. The o-ring 263 keeps pressure and fluid flow from getting into the area where the connections are made.

Figure 6:
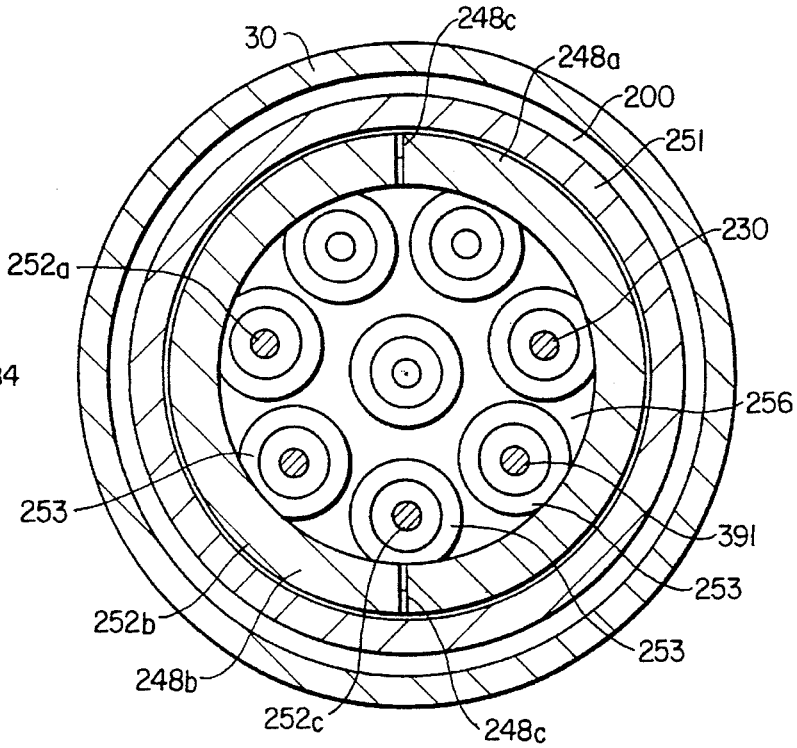
FIG. 6 is a cross-section view taken about the line 6—6 of FIG. 3E.

Referring briefly to FIG. 6, there is shown a cross-sectional view taken about the lines 6—6 of FIG. 3E. There, the system is depicted which includes the outer flow tube 30 within which is positioned the collar 251 defining an annular region 200 for the flow of fluid therebetween. The pair of split halves comprising split sleeves 248*a* and 248*b* joined at junctures 248*c* enclose the electrical connections within a fluid and pressure sealed housing area. The split sleeves 248*a* and 248*b* enclose overlying boots 253 which protect plug connectable electrical connections of the wires 230, 391 and 253*a–c* as well as certain dummy connectors in those positions which are not used. The upper housing 254 comprises the remainder of the connector.

Referring again to FIG. 3E, a retaining ring 266 keeps the insulator block 265 within the housing from coming out. The lower connector housing 267 is mounted to a camera adapter bulkhead 272 by threaded engagement therewith and is sealed thereto by means of o-rings 268. The electronic module 101 comprises an electronics housing 276 containing an electronics assembly 274. The assembly 274 is attached to the lower end of the camera adapter bulkhead 272 by a socket head screw 273 while the electronics housing 276 is attached by socket head screws 269 and sealed thereto by o-rings 270 and 271. A connector receptacle 275 plugs into a mating receptacle on the electronics assembly 274. The outer flow tube 30 is installed after the cable head subassembly, electronics and camera modules are all in place and connected and the flow tube 30 is mechanically pinned to the camera adapter bulkhead 272 by set screws 206.

Figure 4B:
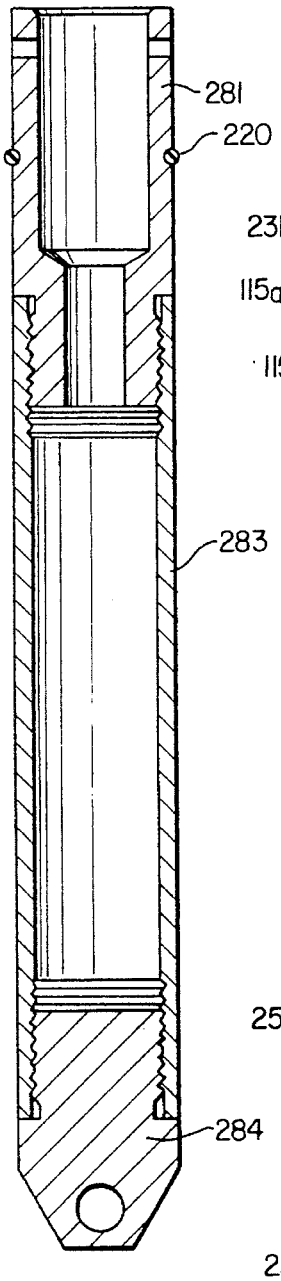
FIG. 4B shows a longitudinal cross-section view of a wiring protection boot attached to the lower end of the tool of FIGS. 3A–3E during threading through a coiled tubing injector.

FIG. 4B depicts an injector feed through boot protector for the coiled tubing cable head subassembly 29 and comprises a split nut boot protector portion 281, a tube boot protector portion 283 which is threadedly joined thereto, and a plug boot protector end piece 284 which threadedly engages and closes the lower end. An o-ring 220 secures the split nut for assembly. The outside diameter of the boot protector of FIG. 4B is approximately the same as that of the fishing neck housing 243 (FIG. 3D). In use, the split sleeve collar 251 is moved upwardly from around the split sleeves 248*a* and 248*b*. The split sleeves 248*a* and 248*b* are separated from one another to expose the quick disconnect connector assembly 119. The contact protection boots 253 and the contact socket assemblies 255 are plug disconnected from the upper ends of the feed through pins 257. Thereafter, the connector 119 and all the equipment below the fishing neck 118 is removed and replaced by the injector feed through boot protector of FIG. 4B by placing the split nut halves over the dowel pin 249 and then threading 283/284 over the split nut, containing and protecting the contact boots. Then the entire coiled tubing cable head subassembly module 29 and the attached coiled tubing can be inserted through the grippers of a coiled tubing injector. The plug connectable wires and contact assemblies 255 are received into the cavities of the boot protector portions 281 and 283 and pass readily through the injector. Once the cable head subassembly is passed through the injector, the boot protector is removed and the quick disconnect connector assembly 119, along with the other equipment including the electronics and camera modules 101 and 102, reinstalled for insertion downhole into the wellbore at the end of the coiled tubing.

As can be seen from the above description, the inspection tool of the present invention enables the emergency separation of the inspection equipment from the coiled tubing cable head subassembly 29 in the event a portion of the equipment becomes stuck down in the well. In such a case strong upward force on the coiled tubing 24 will cause shear wires 245*c* and 245*d* to shear through and allow the cable head subassembly to be removed, exposing the fishing neck 118. In the event the tool has been run into the borehole without the outer flow tube 30, the fishing neck 118 may be grasped by fishing tools sent from the surface to retrieve the parts, otherwise the parts may be removed by attachment to the fishing neck 205 located at the top of the flow tube 30. If the cable head subassembly has been separated from the remainder of the tool by an upward force as described above, the components of the cable head subassembly slide out through the internal fishing neck 205 located at the top of the tool. When such occurs, the power and signal wires will break somewhere between the plug connectors enclosed by boots 253 and the electrical bulkhead connector 117 but the various terminations of the fiberoptic cable 33 and the LED 233 remain sealed and protected from borehole fluids and pressures with which the cable head subassembly 29 will come in contact during removal from the borehole.

The present inspection tool system provides for the selectively connecting and optically coupling of an inspection tool such as a television camera to a conventional coil tube unit which can also be used for other purposes, such as the traditional treatment of a well by injecting fluids downhole. The configuration of the present inspection tool allows disconnection of the inspection modules of the tool in the event they become stuck and enables the cable head subassembly module to be removed as part of the coiled tubing for subsequent retrieval of the inspection modules with a fishing tool. A significant feature of the construction of the inspection tool of the present invention is that the fiberoptic cable is terminated electrically and optically in a manner that maintains the cable straight to reduce optical attenuation while at the same time allowing the ends of the optical fibers to be trimmed shorter in the event they become damaged or substandard in their optical coupling characteristics. The position of the diode holder is longitudinally adjustable as a function of the finished length of the fiberoptic cable and its connector to prevent any bends in the cable and the consequent attenuation introduced by such bends. The adjustable position of the diode holder allows the length of the cable to be modified by trimming the butt end of the optical fibers to ensure a proper coupling with the LED.

Moreover, the system of the present invention includes a downhole inspection sensor, such as a video camera, deployed by means of coiled tubing cable head subassembly which includes a cable seal that allows the diversion of optically clear fluids around the camera and the electrical/optical interconnections within an outer tube to provide a clear viewing medium for the camera. In addition, the cable head subassembly includes a cable clamp which is used to secure the electrical/optical cable within the cable head subassembly and prevent the cable from pulling out of the subassembly in the event of an emergency. Further, the electrical and optical terminations of the cable are sealed off within the subassembly housing against pressure and fluid to prevent damage to the internals of the cable in the event of a cable head subassembly pullout. This sealing means includes a pressure vessel which utilizes a cable seal subassembly to protect the fiberoptic connector area from pressure in the event of an emergency withdrawal and separation of the cable head subassembly from the remainder of the tool.

A connector housing scheme is provided in the present invention which enables ready servicing of the optical fiber connection within its sealed pressurized housing by removing the split halves of that housing for easy access to the electrical/optical connections for servicing. The present system includes the use of shearoff wires whereby the electronics and camera modules may be retrieved without damage in the event of a cable head subassembly pullout exposing the upper end of a fishing tool which can be readily retrieved by means of fishing equipment extended from the surface. In the present system, the cable head can also be fed through a coiled tubing injector without the camera and electronics modules which are somewhat too large and inflexible to go through the injector but provide for the subsequent plug connection attachment of the camera and electronics modules to the cable head subassembly module once it has been passed through the injector housing.

Referring briefly to FIG. 2, it should be noted that while a television camera has been shown as the exemplary modular sensor coupled to the lower end of the cable head subassembly, other modular inspection sensors could be employed such as temperature sensors, pressure sensors, acoustic sensors and/or others which could function desirably within the region of the optically transparent and/or acoustically homogenous bubble 54. In addition, it can be seen that the fluid 52 is used not only to create the optically transparent bubble 54 but also to cool the equipment within electronics and camera modules 101 and 102 and ensure that they operate at an appropriate temperature to provide maximum operational accuracy.

It is thus believed that the operation and construction of the present invention will be apparent from the foregoing discussion. While the method, apparatus and system shown and described has been characterized as being preferred, it would be obvious that various changes and modifications may be made therein without departing from the spirit and scope of the invention as defined in the following claims.

What is claimed is:

1. A method of using a downhole inspection tool to inspect the interior of a borehole comprising:

providing a cable head subassembly module attached to the lower end of a length of coiled tubing having an electrical/fiberoptic cable threaded therethrough, said module including means for terminating the electrical and optical conductors within said cable and for mechanical and electrical connection to an inspection module capable of producing an electrical signal indicative of downhole conditions;

connecting an injector feed through boot protector to said the mechanical terminating means of said cable head subassembly module, said protector receiving therein said electrical terminating means of said subassembly module;

inserting said boot protector, cable head subassembly module and coiled tubing attached thereto through a coiled tubing injector;

removing said boot protector from said cable head subassembly module;

attaching an inspection module to said cable head subassembly module to produce a downhole inspection tool; and running said tool downhole to inspect downhole conditions.

2. A method of using a downhole inspection tool to inspect the interior of a borehole as set forth in claim 1, wherein said injector feed through boot protector has a diameter approximately the same as that of said cable head subassembly module.

3. A method of using a downhole inspection tool to inspect the interior of a borehole as set forth in claim 1 which includes prior to the step of running said tool downhole the additional step of:

providing an outer flow tube having a diameter greater than both of said cable head subassembly module and said inspection module;

inserting said cable head subassembly module and said attached inspection module into said outer flow tube to define an annular space therebetween; and fluid coupling the upper end of said outer flow tube to said coiled tubing for conducting a flow of optically clear and/or acoustically homogeneous fluid down along said annular space and out the lower end of said tool to create downhole a region conducive to inspection by said tool.

4. A method of using a downhole inspection tool to inspect the interior of a borehole as set forth in claim 3 wherein said fluid coupling step includes:

providing a crossover adapter within said cable head subassembly module for direct mechanical and fluid connection to the lower end of said coiled tubing, said adapter being closed at the bottom and including at least one port formed therein to allow the fluid flowing down said coiled tubing to pass to the outside of said adapter and into the annular region contained within said outer flow tube.

5. A method of using a downhole inspection tool to inspect the interior of a borehole as set forth in claim 3 includes the additional steps of:

mechanically connecting said outer flow tube to said inspection module; and mechanically clamping said electrical/fiber optic cable within said cable head subassembly to prevent disturbance of the termination of the conductors thereof upon application of an upward force upon said coiled tubing to disconnect said subassembly from said inspection module and remove it from within said borehole in the event said outer flow tube becomes lodged downhole.

6. A system for using a downhole inspection tool to inspect the interior of a borehole as set forth in claim 3 wherein said fluid coupling means includes:

a crossover adapter within said cable head subassembly module for direct mechanical and fluid connection to the lower end of said coiled tubing, said adapter being closed at the bottom and including at least one port formed therein to allow the fluid flowing down said coiled tubing to pass to the outside of said adapter and into the annular region contained within said outer flow tube.

7. A system for using a downhole inspection tool to inspect the interior of a borehole as set forth in claim 3 which also includes:

means for mechanically connecting said outer flow tube to said inspection module; and means for mechanically clamping said electrical/fiber optic cable within said cable head subassembly to prevent disturbance of terminations of the conductors thereof upon application of an upward force upon said coiled tubing to disconnect said subassembly from said inspection module and remove it from within said borehole in the event said outer flow tube becomes lodged downhole.

8. A system for using a downhole inspection tool to inspect the interior of a borehole comprising:

a cable head subassembly module attached to the lower end of a length of coiled tubing having an electrical/fiberoptic cable threaded therethrough, said module including means for terminating the electrical and optical conductors within said cable and for mechanical and electrical connection to an inspection module capable of producing an electrical signal indicative of downhole conditions;

means for connecting an injector feed through boot protector to said mechanical terminating means of said cable head subassembly module, said protector receiving therein said electrical terminating means of said subassembly module;

means for inserting said boot protector, cable head subassembly module and coiled tubing attached thereto through a coiled tubing injector;

means for removing said boot protector from said cable head subassembly module;

means for attaching an inspection module to said cable head subassembly module to produce a downhole inspection tool; and means for running said tool downhole to inspect downhole conditions.

9. A system for using a downhole inspection tool to inspect the interior of a borehole as set forth in claim 8, wherein said injector feed through boot protector has a diameter approximately the same as that of said cable head subassembly module.

10. A system for using a downhole inspection tool to inspect the interior of a borehole as set forth in claim 8 which also includes:

an outer flow tube having a diameter greater than both of said cable head subassembly module and said inspection module;

means for inserting said cable head subassembly module and said attached inspection module into said outer flow tube to define an annular space therebetween; and means for fluid coupling the upper end of said outer flow tube to said coiled tubing for conducting a flow of optically clear and/or acoustically homogeneous fluid down along said annular space and out the lower end of said tool to create downhole a region conducive to inspection by said tool.

11. A downhole inspection tool for attachment to the lower end of a length of coiled tubing having an electrical/fiberoptic cable threaded therethrough and carrying a flow of optically clear and/or acoustically homogeneous fluid from a supply of said fluid at the surface, said tool comprising:

a cable head subassembly module attached to the lower end of said coiled tubing and including means for terminating the electrical and optical conductors within said cable;

an inspection module for producing an electrical signal indicative of downhole conditions;

means for detachably connecting said inspection module to the lower end of said cable head subassembly module;

an outer flow tube mechanically connected to said inspection module and surrounding both of said modules to define an annular space therebetween, said tube having its upper end fluid coupled to said coiled tubing for conducting the flow of said optically clear and/or acoustically homogeneous fluid down along said annular space and out the lower end of said tool to create a region conducive to inspection by said tool;

wherein said cable head subassembly comprises:

a crossover adapter for direct mechanical and fluid connection to the lower end of said coiled tubing, said adapter being closed at the bottom and including at least one port formed therein to allow the fluid flowing down said coiled tubing to pass to the outside of said adapter and into the annular region contained within said outer flow tube.

12. A downhole inspection tool as set forth in claim 11 wherein said cable head subassembly comprises:

means for fluid sealing the outside surface of said electrical/fiberoptic cable to said crossover adapter to close the bottom thereof and force the fluid flowing flown said coiled tubing into said adapter to pass out into the annular region through said at least one port.

13. A downhole inspection tool for attachment to the lower end of a length of coiled tubing having an electrical/fiberoptic cable threaded therethrough and carrying a flow of optically clear and/or acoustically homogeneous fluid from a supply of said fluid at the surface, said tool comprising:

a cable head subassembly module attached to the lower end of said coiled tubing and including means for terminating the electrical and optical conductors within said cable;

an inspection module for producing an electrical signal indicative of downhole conditions;

means for detachably connecting said inspection module to the lower end of said cable head module;

an outer flow tube mechanically connected to said inspection module and surrounding both of said modules to define an annular space therebetween, said tube having its upper end fluid coupled to said coiled tubing for conducting the flow of said optically clear and/or acoustically homogeneous fluid down along said annular space and out the lower end of said tool to create a region conducive to inspection by said tool;

wherein said cable head subassembly comprises:

means for mechanically clamping said electrical/fiberoptic cable within said cable head subassembly to prevent disturbance of the termination of its conductors upon application of an upward force upon said coiled tubing to disconnect said subassembly from said inspection module and remove it from within said borehole in the event said outer flow tube becomes lodged downhole.

14. A downhole inspection tool as set forth in claim 13 wherein said outer flow tube includes a fishing neck located near the upper end thereof to enable removal, following removal of said cable head assembly, of said flow tube and inspection module from within said borehole.

15. A downhole inspection tool for attachment to the lower end of a length of coiled tubing having an electrical/fiberoptic cable threaded therethrough and carrying a flow of optically clear and/or acoustically homogeneous fluid from a supply of said fluid at the surface, said tool comprising:

a cable head subassembly module attached to the lower end of said coiled tubing and including means for terminating the electrical and optical conductors within said cable;

an inspection module for producing an electrical signal indicative of downhole conditions;

means for detachably connecting said inspection module to the lower end of said cable head subassembly module;

an outer flow tube mechanically connected to said inspection module and surrounding both of said modules to define an annular space therebetween, said tube having its upper end fluid coupled to said coiled tubing for conducting the flow of said optically clear and/or acoustically homogeneous fluid down along said annular space and out the lower end of said tool to create a region conducive to inspection by said tool;

wherein said electrical/fiberoptic cable includes an inner core of at least one optical fiber surrounded by an stainless steel tube covered with and insulative jacket over which is formed a braided conductive layer also surrounded by an insulative layer over which a stranded conductor is wound for strength, said cable head subassembly further comprising:

means for sealing the outside stranded surface of said cable against the fluid flowing down said coiled tubing and forcing said fluid into said outer flow tube;

means for mechanically clamping the exposed stranded conductor of said electrical/fiberoptic cable to secure the cable within said cable head subassembly and prevent disturbance of the terminations of the conductors therein upon the application of an upward force upon said coiled tubing to disconnect said subassembly from said inspection sensor module and remove it from within said borehole in the event said outer flow tube becomes lodged downhole, said stranded conductor being cut away below said mechanical clamping means to expose said insulative layer;

an enclosed chamber for containing the electrical and optical terminations of the remaining conductors within said cable; and means for fluid and pressure sealing said insulative layer of said cable against fluid intrusion into said enclosed chamber.

16. A downhole inspection tool as set forth in claim 15 wherein said cable head subassembly also comprises:

means within said enclosed chamber for making electrical connection with the braided conductive layer and the stranded conductor of said cable to supply electrical power from a source at the surface to downhole equipment;

means within said enclosed chamber for making optical termination with said at least one optical fiber comprising the inner core of said cable; and a light emitting diode housing mounted for longitudinal movement within said enclosed chamber to position a diode in direct abutting relationship with the butt end of the terminated at least one optical fiber irrespective of the length of said cable within said chamber.

17. A downhole inspection tool as set forth in claim 16 wherein said cable head subassembly further comprises:

a light emitting diode mounted within said housing and connected to electrical signal carrying conductors for converting the signals on said conductors into light signals and coupling said light signals into said at least one optical fiber for transmission up said cable to the surface;

a pressure and fluid sealed chamber bulkhead closing the lower end of said enclosed chamber and including a through connector for making electrical connection with each of said electrical signal and electrical power carrying conductors; and a connector for detachably coupling to the terminals of said chamber bulkhead through connector and having electrical leads connected to each of said signal and power conductors outside of said enclosed chamber.

18. A downhole inspection tool as set forth in claim 17, in which said enclosed chamber comprises:

a pair of semi-cylindrical shells joined at opposite edges to form said chamber, said shells being separable from one another to allow access to the electrical and optical connections therein; and a cylindrical housing positioned around said assembled shells and sealed thereto near opposite ends thereof to form a fluid and pressure tight enclosed for said connections.

19. A downhole inspection tool as set forth in claim 18 in which said inspection module further comprises:

a fishing neck housing having a fishing neck extending up into the open lower end of said cylindrical housing;

a quick disconnect connector assembly mounted to the lower end of said fishing neck housing, said assembly including a housing through connector bulkhead having electrical terminals on both sides thereof;

means for detachably connecting the electrical leads of each of said signal and power conductors from the connector coupled to said chamber bulkhead through connector to one of the electrical terminals on the top of said housing through connector; and shear wire means for securing said cylindrical housing to said fishing neck housing and adapted to shear off upon a preselected upward tension upon said coiled tubing and enable withdrawal of said cable head subassembly module from within said borehole to leave said fishing neck exposed for subsequent retrieval of said inspection module.

20. A downhole inspection tool as set forth in claim 19 in which said outer flow tube also includes an inner fishing neck formed near the upper end thereof for retrieval from the surface.

21. A downhole inspection tool as set forth in claim 19 which also comprises:

a camera adapter bulkhead having a first upper connector for detachably connecting to each one of the electrical terminals on the bottom of said housing through connector from an electronics package contained within said inspection module; and means for mechanically attaching said camera adapter bulkhead to said outer flow tube.

22. A downhole inspection tool as set forth in claim 18 in which said cylindrical housing includes an open portion extending beyond the lower end of said assembled shells and said tool further comprises:

an injector feed through boot protector having a diameter approximately the same as that of said cylindrical housing for detachable connection to the lower end thereof to receive the electrical leads connected to each of said signal and power conductors outside of said enclosed chamber and to guide insertion of said cable head subassembly module and said coiled tubing through a coiled tubing injector, said boot protector being replaceable by said inspection module following said insertion.

23. A downhole inspection tool as set forth in claim 15, in which said enclosed chamber comprises:

a pair of semi-cylindrical shells joined at opposite edges to form said chamber, said shells being separable from one another to allow access to the electrical and optical connections therein; and a cylindrical housing positioned around said assembled shells and sealed thereto near opposite ends thereof to form a fluid and pressure tight enclosure for said connections.

24. A downhole inspection system comprising:

a length of coiled tubing for carrying a flow of optically clear and/or acoustically homogeneous fluid from a supply of said fluid at the surface;

an electrical/fiberoptic cable threaded through said coiled tubing for carrying electrical power and signals between the surface and a downhole location;

a cable head subassembly module attached to the lower end of said coiled tubing and including means for mechanically clamping said cable to secure said cable within said subassembly and a fluid and pressure sealed chamber for containing terminations of downhole ends of the electrical and optical conductors within said cable and means for converting an electrical signal to an optical signal and transmitting said signal ion the optical conductors of said cable;

an inspection module for producing an electrical signal indicative of downhole conditions;

means for detachably connecting said inspection module to the lower end of said cable head assembly module for both mechanical support thereof and for coupling the electrical signal produced by said inspection module to said signal converting means within said sealed chamber;

an outer flow tube mechanically connected to said inspection module and surrounding both of said modules to define an annular space therebetween, said tube having its upper end fluid coupled to said coiled tubing for conducting the flow of said optically clear and/or acoustically homogeneous fluid down along said annular space and out the lower end of said tool to create a region conducive to inspection by said inspection module;

wherein said cable head subassembly module also includes:

a crossover adapter for direct mechanical and fluid connection to the lower end of said coiled tubing, said adapter being closed at the bottom and including a plurality of ports formed therein to allow the fluid flowing down said coiled tubing to pass to the outside of said adapter and into the annular region contained within said outer flow tube.

25. A downhole inspection system comprising:

a length of coiled tubing for carrying a flow of optically clear and/or acoustically homogenous fluid from a supply of said fluid at the surface;

an electrical/fiberoptic cable threaded through said coiled tubing for carrying electrical power and signals between the surface and a downhole location;

a cable head subassembly module attached to the lower end of said coiled tubing and including means for mechanically clamping said cable to secure said cable within said subassembly and a fluid and pressure sealed chamber for containing terminations of downhole ends of the electrical and optical conductors within said cable and means for converting an electrical signal to an optical signal and transmitting said signal on the optical conductors of said cable;

an inspection module for producing an electrical signal indicative of downhole conditions;

means for detachably connecting said inspection module to the lower end of said cable head assembly module for both mechanical support thereof and for coupling the electrical signal produced by said inspection module to said signal converting means within said sealed chamber;

an outer flow tube mechanically connected to said inspection module and surrounding both of said modules to define an annular space therebetween, said tube having its upper end fluid coupled to said coiled tubing for conducting the flow of said optically clear and/or acoustically homogenous fluid down along said annular space and out the lower end of said tool to create a region conducive to inspection by said inspection module; and wherein said cable head subassembly module also includes:

a crossover adapter for direct mechanical and fluid connection to the lower end of said coiled tubing, said adapter being closed at the bottom and including a plurality of ports formed therein to allow the fluid flowing down said coiled tubing to pass to the outside of said adapter and into the annular region contained within said outer flow tube; and means for fluid sealing the outside surface of said electrical/fiber optic cable to said crossover adapter to close the bottom thereof and force the fluid flowing down said coiled tubing into said adapter to pass out into the annular region through said ports.

26. A downhole inspection system comprising:

a length of coiled tubing for carrying a flow of optically clear and/or acoustically homogeneous fluid from a supply of said fluid at the surface;

an electrical/fiberoptic cable threaded through said coiled tubing for carrying electrical power and signals between the surface and a downhole location;

a cable head subassembly module attacked to the lower end of said coiled tubing and including means for mechanically clamping said cable to secure said cable within said subassembly and a fluid and pressure sealed chamber for containing terminations of downhole ends of the electrical and optical conductors within said cable and means for converting an electrical signal to an optical signal and transmitting said signal on the optical conductors of said cable;

an inspection module for producing an electrical signal indicative of downhole conditions;

means for detachably connecting said inspection module to the lower end of said cable head assembly module for both mechanical support thereof and for coupling the electrical signal produced by said inspection module to said signal converting means within said sealed chamber;

an outer flow tube mechanically connected to said inspection module and surrounding both of said modules to define an annular space therebetween, said tube having its upper end fluid coupled to said coiled tubing for conducting the flow of said optically clear and/or acoustically homogeneous fluid down along said annular space and out the lower end of said tool to create a region conducive to inspection by said inspection module;

wherein said electrical/fiber optic cable includes an inner core of at least one optical fiber within a steel tube surrounded by an insulative jacket over which is formed a braided conductive layer also surrounded by an insulative layer over which a stranded conductor is wound for strength, said cable head subassembly module also including:

means for fluid sealing the outside surface of said cable against the fluid flowing down said coiled tubing; and means for mechanically clamping the exposed stranded conductor of said electrical/fiber optic cable to secure the cable within said cable head subassembly and prevent disturbance of the terminations of the conductors thereof upon application of an upward force upon said coiled tubing to disconnect said subassembly from said inspection sensor module and remove it from within said borehole in the event said outer flow tube becomes lodged downhole, said stranded conductor being cut away below said mechanical clamping means to expose said insulative layer.

27. A downhole inspection system comprising:

a length of coiled tubing for carrying a flow of optically clear and/or acoustically homogeneous fluid from a supply of said fluid at the surface;

an electrical/fiberoptic cable threaded through said coiled tubing for carrying electrical power and signals between the surface and a downhole location;

a cable head subassembly module attached to the lower end of said coiled tubing and including means for mechanically clamping said cable to secure said cable within said subassembly and a fluid and pressure sealed chamber for containing terminations of downhole ends of the electrical and optical conductors within said cable and means for converting an electrical signal to an optical signal and transmitting said signal on the optical conductors of said cable;

an inspection module for producing an electrical signal indicative of downhole conditions;

means for detachably connecting said inspection module to the lower end of said cable head assembly module for both mechanical support thereof and for coupling the electrical signal produced by said inspection module to said signal converting means within said sealed chamber;

an outer flow tube mechanically connected to said inspection module and surrounding both of said modules to define an annular space therebetween, said tube having its upper end fluid coupled to said coiled tubing for conducting the flow of said optically clear and/or acoustically homogeneous fluid down along said annular space and out the lower end of said tool to create a region conducive to inspection by said inspection module;

wherein said sealed chamber of said cable head subassembly comprises:

a pair of semi-cylindrical shells joined at opposite edges to form said chamber, said shells being separable from one another to allow access to the electrical and optical connections therein; and a cylindrical housing positioned around said assembled shells and sealed thereto near opposite ends thereof to form a fluid and pressure tight enclosure for said connections.

* * * * *